US008347847B2

(12) United States Patent
Oledzki

(10) Patent No.: US 8,347,847 B2
(45) Date of Patent: Jan. 8, 2013

(54) INTERNAL COMBUSTION TWO STROKE OSCILLATING ENGINE

(76) Inventor: Wieslaw Julian Oledzki, Bialystok (PL)

( * ) Notice: Subject to any disclaimer, the term of this patent is extended or adjusted under 35 U.S.C. 154(b) by 933 days.

(21) Appl. No.: 12/386,476

(22) Filed: Apr. 20, 2009

(65) Prior Publication Data

US 2010/0263616 A1 Oct. 21, 2010

(51) Int. Cl.
*F02B 53/04* (2006.01)
*F02B 53/00* (2006.01)

(52) U.S. Cl. ..... 123/223; 123/242; 123/212; 123/214; 123/241; 123/243; 123/43 B

(58) Field of Classification Search ..... 123/201, 123/223, 242, 212, 214, 243, 43 B, 221, 230, 123/241, 18 R; 418/36, 37
See application file for complete search history.

(56) References Cited

U.S. PATENT DOCUMENTS

| | | | | |
|---|---|---|---|---|
| 3,476,056 | A * | 11/1969 | Bright | 418/36 |
| 3,529,581 | A * | 9/1970 | Braun | 123/18 R |
| 4,005,687 | A * | 2/1977 | Jonathan | 123/18 R |
| 4,257,752 | A * | 3/1981 | Fogarty | 418/37 |
| 5,676,534 | A * | 10/1997 | Hiscock | 418/36 |
| 8,171,911 | B2 * | 5/2012 | Oledzki | 123/223 |

FOREIGN PATENT DOCUMENTS

WO WO 2007083254 A2 * 7/2007

* cited by examiner

*Primary Examiner* — Mary A Davis

(57) ABSTRACT

The invention relates to heat engines and more specifically to positive displacement internal combustion engines, and is particularly concerned with oscillating engines i.e. engines, in which piston executes oscillating motion. The invention provides the optimal, "canonical" form for the two stroke oscillating engine of unique strenght and compactness.

8 Claims, 12 Drawing Sheets

INTERNAL COMBUSTION TWO STROKE OSCILLATING ENGINE

TECHNICAL FIELD OF THE INVENTION

The invention relates to heat engines and more specifically to positive displacement internal combustion engines, and is particularly concerned with oscillating engines i.e. engines, in which piston executes oscillating motion. The invention provides the optimal, "canonical" form for the two stroke oscillating engine of unique strength and compactness.

STATE OF THE ART AND BACKGROUND OF THE INVENTION

Existing successful heat engines are steam turbines, gas turbines and positive displacement engines (reciprocating piston and rotary Wankel) utilizing various thermodynamic cycles (Diesel (or rather Sabathe), Otto and Stirling cycle). These engines, although now having been developed for more than century (almost 2 centuries in the case of Stirling), still stop short from fulfilling the requirements imposed on prime movers by modern economy. Thus steam turbines require huge steam boilers and steam condensers and are troublesome to exploit, therefore their applications are restricted to power plants and propulsion of ships and some other heavy machinery. Gas turbines, thermal efficiency of which can achieve even 65% in large units destined for power generation and industrial applications (e.g. in most recent large turbines built by GE, which in fact are compound heat machines with large heat exchanger), usually, particularly in small units, display much poorer figure than positive displacement engines, are more complicated technologically and more expensive, and therefore are unlikely to earn as dominant position as Diesels enjoy today due to these and other well-known inherent drawbacks and limitations. Thus positive displacement engines still have important advantages over turbines that render them irreplaceable for most applications.

Most common positive displacement engine in use (and in fact most common heat engine), Diesel engine, achieves maximum overall efficiency of slightly beyond 50% (arge stationary or marine units, which again are compound heat machines comprising Diesel engine, turbocharger, supercharging air cooler and auxiliary power turbine), and average Diesel efficiency is merely ~40%, a poor figure in comparison with 70-75% originally assumed by its inventor in late $19^{th}$ century. Thermal efficiency of Diesel cycle rises with the compression ratio, but this method for improving overall efficiency of real Diesel engines is obstructed by friction loses rapidly rising with loads of engine's mechanism. Moreover, conventional connecting rod—crank mechanism's strength becomes a concern in highly loaded Diesel engines.

Another well-known positive displacement heat engine is the (external combustion) Stirling engine. This engine is closest to the ideal Carnot engine in terms of thermal efficiency, and another important advantage over known internal combustion engines is its capability to utilize various sources of thermal energy. However, Stirling engine is expensive to manufacture and troublesome to maintain, and this renders it considerably inferior to internal combustion engine in most applications, and prevents from earning wide acceptance.

There are many non-conventional designs of heat engines (most of them focusing on transforming gas force into driving torque of rotating shaft), e.g. rotary engines like Wankel, recently patented quasi turbine (see U.S. Pat. Nos. 6,164,263 and 6,899,075), spherical engines (see U.S. Pat. Nos. 6,325,038, and 6,941,900, and Russian patent 2,227,211) and oscillating pivotal engine (see www.PivotalEngine.com). However, so far none of those non-conventional engines, with Wankel-type engine being the only exception of economically (but certainly not conceptually) marginal importance, was successful, and probably none of them has any chance to even go beyond the stage of prototyping. Technically, this is due to the fact that the answer to the principal question any new engine is obliged to answer: "Does the new engine do its work better than conventional one?" is decidedly negative for all those non-conventional designs, including Wankel's. Even the answer to the more general question: "Does the new engine do its work in any aspect better than conventional one?" is negative for almost all non-conventional engines. (In the case of the Wankel engine, the answer to this more general question is positive, but superiority of Wankel over conventional engines in certain aspects (great power/weight and power/volume ratios, kinetic simplicity and smoothness of operation) is overshadowed by its inherent drawbacks (weak structure, inability to cope with large outputs, inferior efficiency, weakness of sealing, inherent inability to incorporate high compression ratios)). Conceptually, this is mainly due to the fact that those new engine designs (e.g. quasi turbine) focus on certain isolated aspects of heat engine while ignoring some other aspects (e.g. sealing, mechanical strength and reliability).

Fuel cell is a very promising source of power for many applications, but it seems improbable it will become appropriate for applications where high power density is essential in any foreseeable future.

Thus there is a need for highly efficient universal source of mechanical power, and highly efficient and clean thermodynamic processes for producing hot high pressure gases, like detonation, compression ignited combustion of homogeneous charge and very high-pressure Sabathe cycle, render positive displacement internal combustion engines a very interesting proposition, provided that efficient way for converting thermal energy into useful mechanical power is incorporated. It is to be stressed that lack of such effective method for converting thermal energy into driving torque is an important obstacle to develop a practical Homogeneous Charge Compression Ignition (HCCI) and Positive Displacement Detonation (PDD) engine. The reason is that maximum gas forces themselves, as well as gradients of gas forces (understood as function of time), met with in HCCI and PDD engines (at least those utilizing stoichiometric mixture, which is the most efficient thermodynamically, and also most efficient from the point of view of power/weight and power/volume parameters) are much higher than in conventional IC engines, and conventional mechanisms are unable to cope with such extreme loads. This is one of the reasons, for which the planned "HCCI engines" are to utilize the more efficient HCCI mode of operation only while producing power at a moderate rate (and working on loan mixtures), converting into ordinary Diesel mode of operation when the power demand rises (the other reason is that IC engine working on loan mixture produces less pollutant nitrogen oxides).

It is to be stressed that none of the non-conventional engine designs in United States Patent and Trademark Office (USPTO) and European Patent Office (EPO) patent data bases offers satisfactory mechanical structure of the ICE suitable for coping with extreme loads while assuring engine's compactness and good sealing. Moreover, none of the known positive-displacement internal combustion engines approaches highly desirable structural simplicity of gas turbines.

SUMMARY OF THE INVENTION

Thus the principal objective of the present invention is to provide a high power density positive-displacement internal combustion engine of simple and extraordinarily robust structure, capable to withstand extremely high loads and to utilize highly efficient HCCI and PDD modes of operation.

Another objective of the invention is to provide a structure for a valve-less two stroke engine that guarantees good constraint for engine's piston and piston sealing elements.

Yet another objective of the invention is to provide a structure for the internal combustion engine with no hot load bearing sliding elements.

Another objective of the invention is to substantially increase thermal efficiency of engines by improving combustion and increasing such parameters as maximum combustion pressure without increasing specific loads of engine's parts.

It is clear that at the core of such an engine should be a mechanism, desirably the strongest and simplest mechanism in existence, that would provide the optimal method for converting gas pressure directly into rotary movement of a solid body.

In order to find such a mechanism some initial conditions should be imposed upon it. Thus gears (toothed wheels) or other mechanisms comprising elements meeting along a line, mechanisms complex from kinetic point of view (for example comprising elements executing complex motion) loaded with extreme gas forces and rendering the engine difficult to seal are unacceptable.

Thus the general idea behind the invention is to take a solid body, as regular as possible, cut out the combustion chamber, and cut the remaining portion of the body along some surfaces (preferably planes) into a minimum number of elements of a mechanism capable of converting gas pressure directly into driving torque (that is to say executing pure rotary movement, or at least "close" to it). This would provide the simplest, strongest, most robust and compact (no vacuum inside of the engine) structure of internal combustion engine, capable of bearing extreme mechanical loads produced by high-efficiency thermodynamic processes without increasing specific loads and friction losses, and substantially improving weight/power ratio at the same time, thus displaying substantial overall efficiency improvement over existing heat engines.

The construction of the strongest mechanisms in existence presented below provides strong indications that the proper form of the engine capable to satisfy all the above-formulated requirements is the oscillating engine. Thus another, more specific objective of the present invention is to provide the proper form of the oscillating engine.

Now I present a short description of my method for achieving the strongest mechanism in existence capable of being applied in positive displacement engines. In fact the construction of these mechanisms lies at the very heart of the present invention.

The construction will be carried out in several simple steps (see FIGS. 1-7).

A. In the Euclidean 3-dimensional space choose a ball BL of radius R and center O and four vectors $v_w$,$v_d$,$v_{mw}$ and $v_{md}$ of length R and based at the point O (FIG. 1). Any two of these vectors should not be parallel.

B. Fix planes π(w), π(d), π(mw) and π(md) perpendicular to the vectors $v_w$, $v_d$, $v_{mw}$ and $v_{md}$ respectively so as each of these planes non-trivially intersects the ball BL (FIG. 1).

C. Cut the ball BL along the planes π(w),π(d),π(mw) and π(mw) into five components, say 1,2,3,4,5 (FIG. 2). Reject two extreme components 1 and 5 and save three central elements 2,3,4. These elements are segments of the ball BL bounded respectively -by pairs of the planes: (π(w),π(mw)), (π(mw),π(md)) and (π(d),π(md)), and are denoted by W, M, and D respectively (FIG. 2). W, M, and D are the "moving" links of the desired mechanism.

D. Take another element L with (substantially) spherical bore chamber BL1 of radius R and two flat surfaces FW and FD perpendicular to the vectors $v_w$,$v_d$ respectively; the distance from the center of the chamber BL1 to the flat surface FW (resp. FD) equals the distance from the center of the ball BL to the plane π(w) (resp. π(d)) (FIG. 3). The element L will be called the body of the mechanism.

E. Insert the elements W, M, and D in the bore chamber BL1 of the element L as shown in FIG. 4 (clearly this can be done in only one way).

The resulting device is the desired (spatial) mechanism. It has five kinetic couples, namely (L,W), (W,M), (M,D), (D,L) and (M,L). The couples (L,W), (W,M), (M,D), (D,L) are higher rotational kinetic couples, while the couple (M,L) is a lower ball joint-like kinetic couple.

In order to enable receiving mechanical energy produced inside the mechanism body, we have to make "moving" elements of the mechanism accessible from the exterior of the body L. This is achieved by equipping said body L with one or two circular bore chambers that accommodate a pin attached to the element W or D or both (FIG. 5).

REMARK 1. In general this procedure provides spatial mechanisms, but in a limiting case it can give flat mechanisms, and in this case all the parts of the mechanism are obtained by cutting a cylinder rather than a ball into 4 pieces, each of them bearing circular symmetry. From the mathematical point of view, the flat mechanism alluded to above is a limiting case of the spatial mechanism obtained by placing the point O at infinity and letting the radius R tend to infinity. In this way we get a mechanism composed of three ordinary flat eccentrics W, M, D placed in the body L, which is composed of four higher (rotational) couples (L,W), (W,M), (M,D), (D,L). In this case the vectors $v_w$,$v_d$, $v_{mw}$ and $v_{md}$ (directional vectors of the axes of rotation of the kinetic couples) are all mutually parallel (FIGS. 6 and 7). The present invention utilizes only flat mechanisms.

REMARK 2. It is clear from this description and accompanying figures that this is the strongest mechanism in existence (which is not merely a kinetic pair such as the ball joint) as its 3 moving parts occupy the whole internal space of its body and all its components assume general form of the ball or segments of a ball. Therefore the mechanism is particularly well suited for heavy-duty applications, including high power density, extreme loads, detonation and HCCI engines. Another unusual feature of the presented 4-link spatial mechanism is that its four elements form five kinetic pairs, namely (L,W), (W,M), (M,D), (D,L) and (M,L). The presence of an extra kinetic pair (M,L) (which is a lower ball joint-like kinetic couple) contributes significantly to the mechanism strength and further decreases specific loads.

REMARK 3. It is clear that kinetics of the spatial mechanism is determined exclusively by the relative position of the vectors $v_w$, $v_d$,$v_{mw}$ and $v_{md}$ or, equivalently, by the angles between these vectors (this will be discussed below).

Similarly, kinetics of the "flat" mechanism is determined by the distances between the axes of rotation of the mechanism elements.

In order to determine kinetics of the spatial mechanism we join the end points of the vectors $v_w$,$v_d$,$v_{mw}$ and $v_{md}$ by geodesic arcs placed in the sphere BL to obtain the ordinary spherical geodesic tetragon (FIG. 1). This proves that from the kinetic point of view our mechanism is the ordinary spherical four-bar linkage.

Similarly, from the kinetic point of view, the "flat" mechanism is the usual flat four-bar linkage. This can be seen by suitably joining by straight segments the intersection points of the rotation axes of the elements W, M and D determined by the vectors $v_w$,$v_d$,$v_{mw}$ and $v_{md}$ with a plane perpendicular to these vectors.

Thus any kinetic pair of the presented mechanism is the rotary or spherical one, and the mechanism is capable of producing rotary movement of one of its elements from oscillating movement of another element and rotary movement of one of its elements from rotary-oscillating movement of some other elements. This feature is utilized in my engine presented in the next section.

REMARK 4. Specific loads within the mechanism (given external loads applied to the mechanism) depend on the relative position of the vectors $v_w$, $v_d$, $v_{mw}$ and $v_{md}$, as well as on the radius R and distances from the center O to the planes π(w),π(d),π(mw) and π(md).

REMARK 5. It is worth noticing that the presented mechanism is not only simple structurally, but also easy to manufacture. All its moving elements have the same very simple structure thus can be manufactured using the same general-purpose machines like forging machine, lathe and milling machine, quite unlike the mechanism of the ordinary piston engine comprising technologically different and complicated elements (crankshaft) and requiring highly specialized equipment to manufacture.

Below I present one variant of the oscillating engine utilizing the flat mechanism constructed above.

BRIEF DESCRIPTION OF THE DRAWINGS

FIG. 8 is the kinetic scheme of the engine mechanism;

FIG. 9 is an expanded engine's view;

FIG. 10 is a partially expanded view showing how the engine parts fit together;

FIG. 11 illustrates some details of the engine sealing system;

FIG. 12 shows subsequent stages of engine's work.

DETAILED DESCRIPTION OF THE PREFERRED EMBODIMENT

Figure 1:
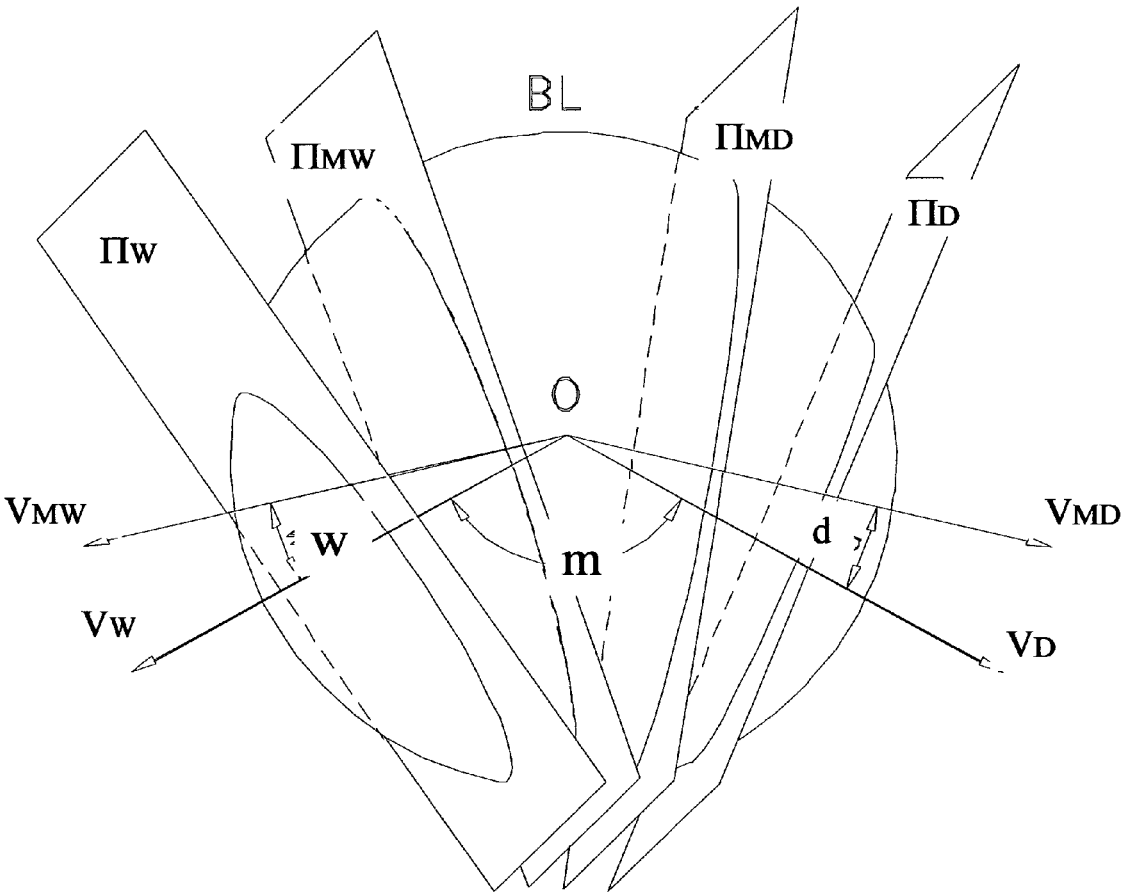
FIGS. 1-7 illustrate the construction of my mechanisms described in the previous paragraph.
Figure 2:
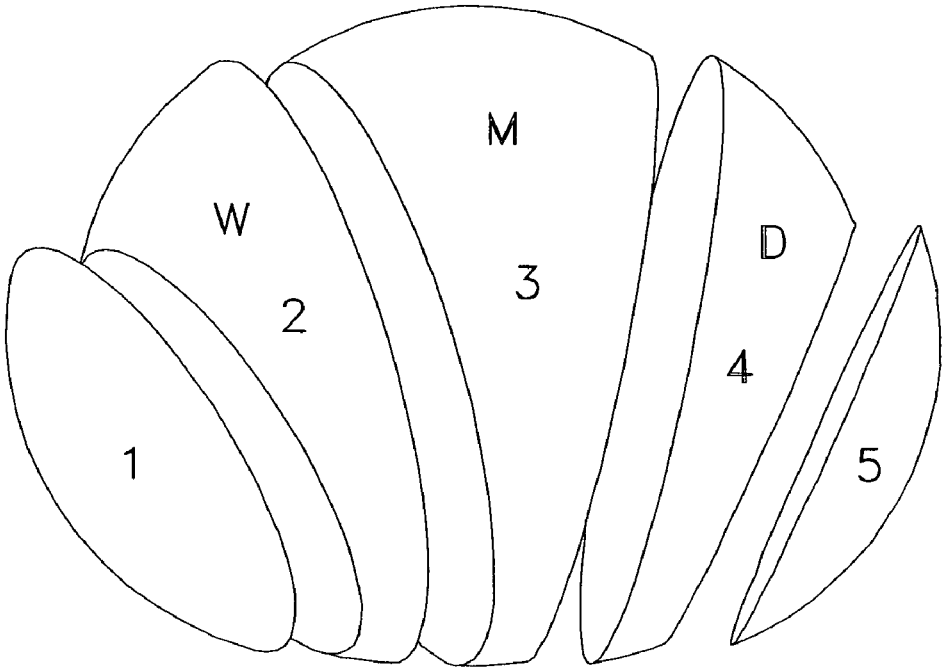
Figure 3:
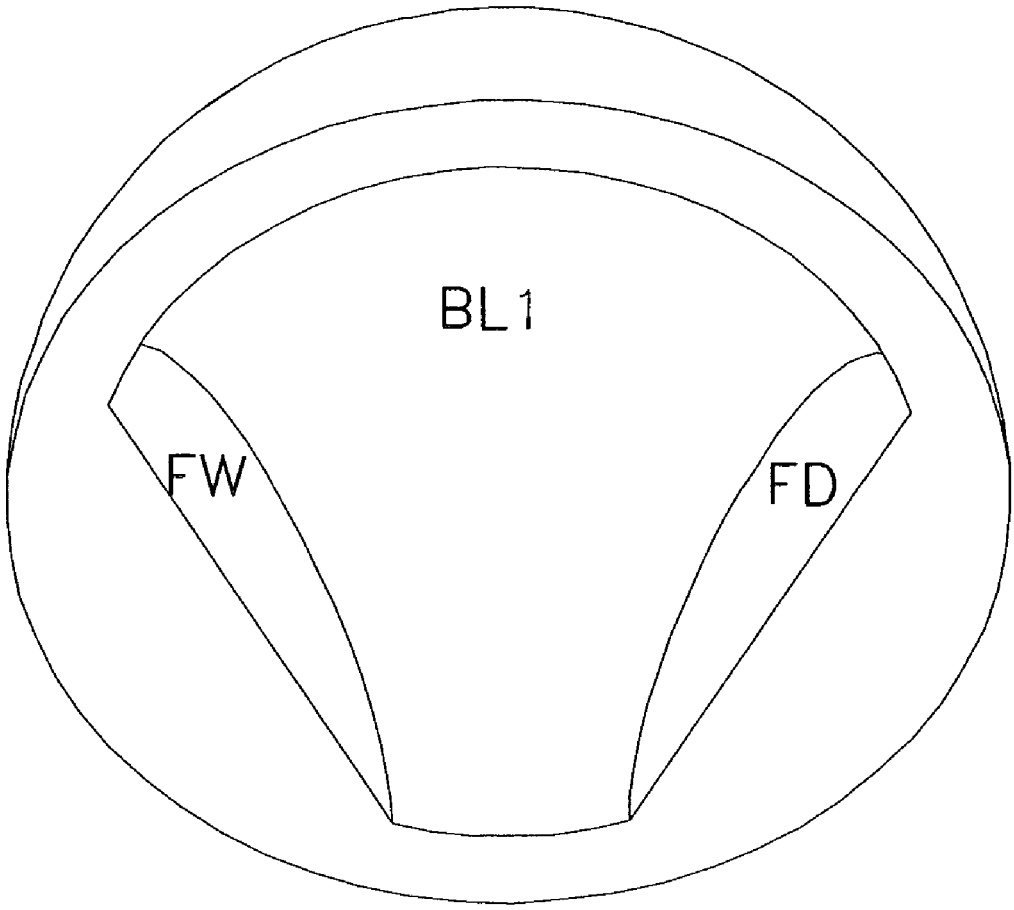
Figure 4:
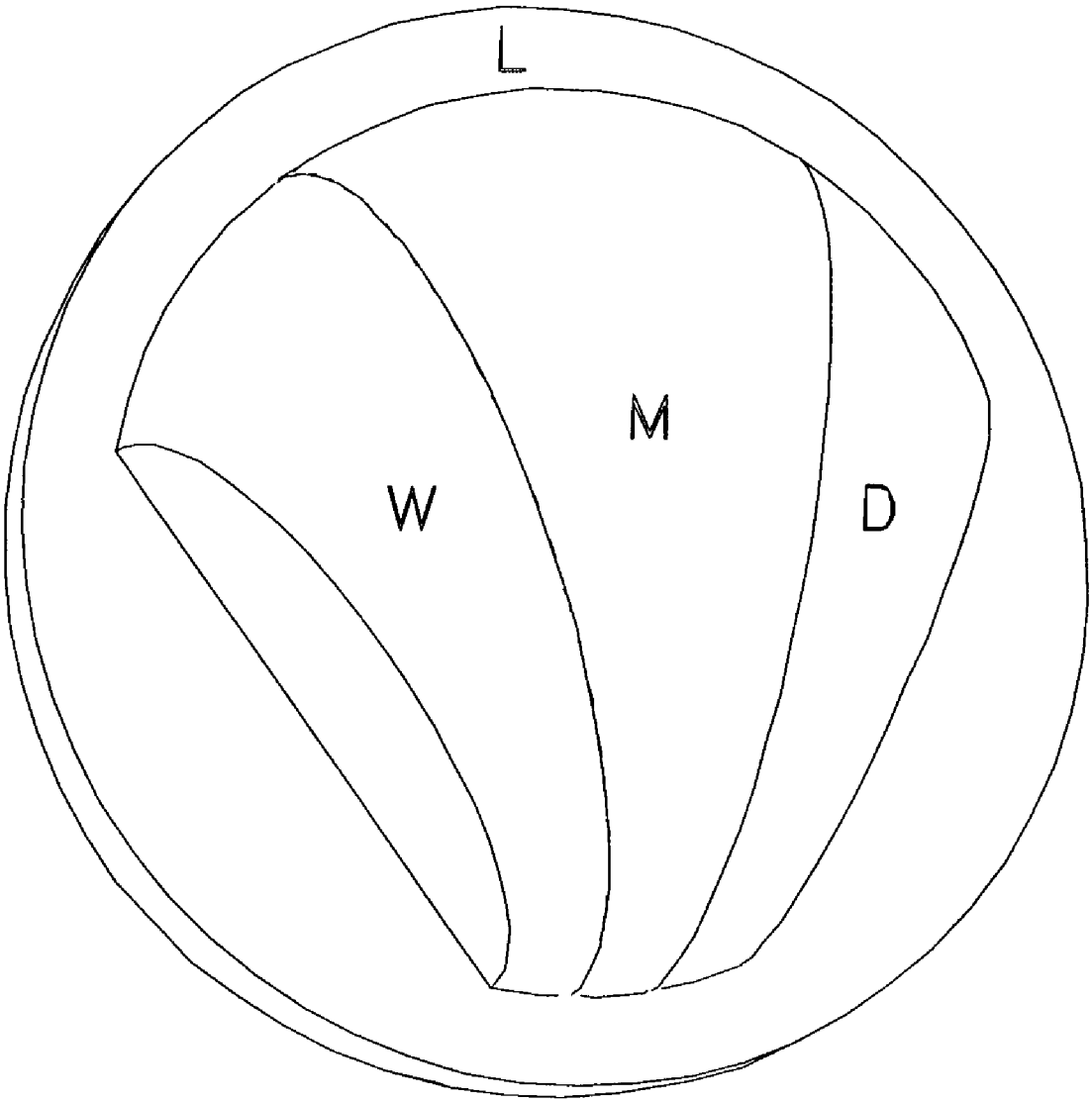
Figure 5:
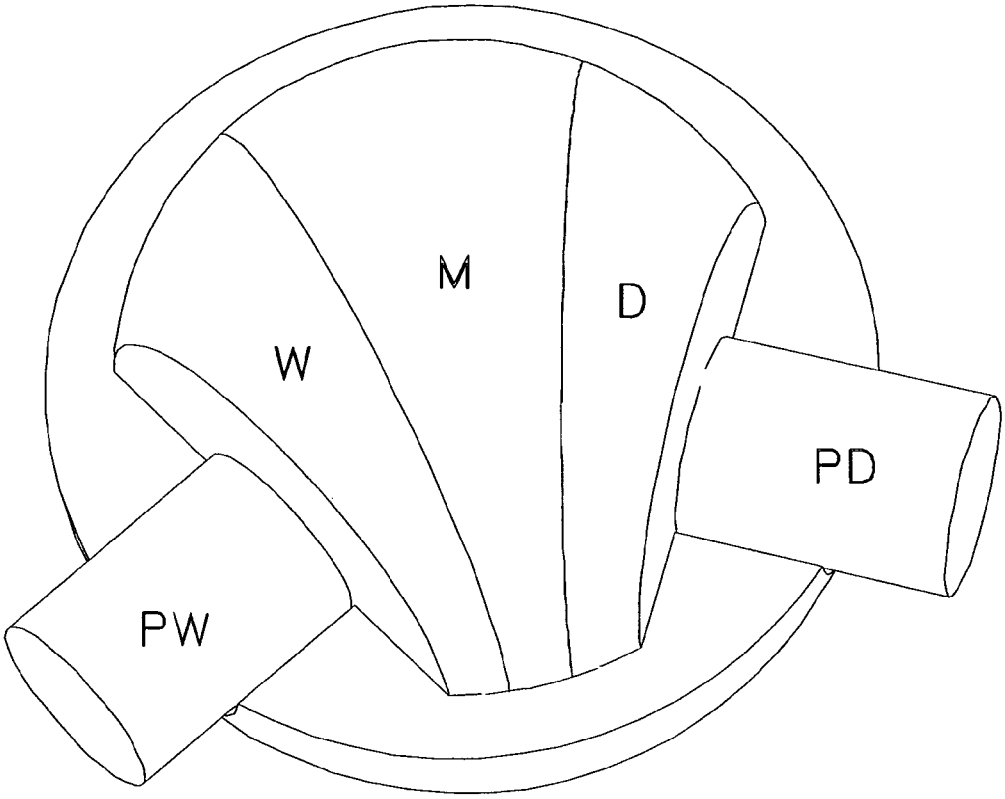
Figure 6:
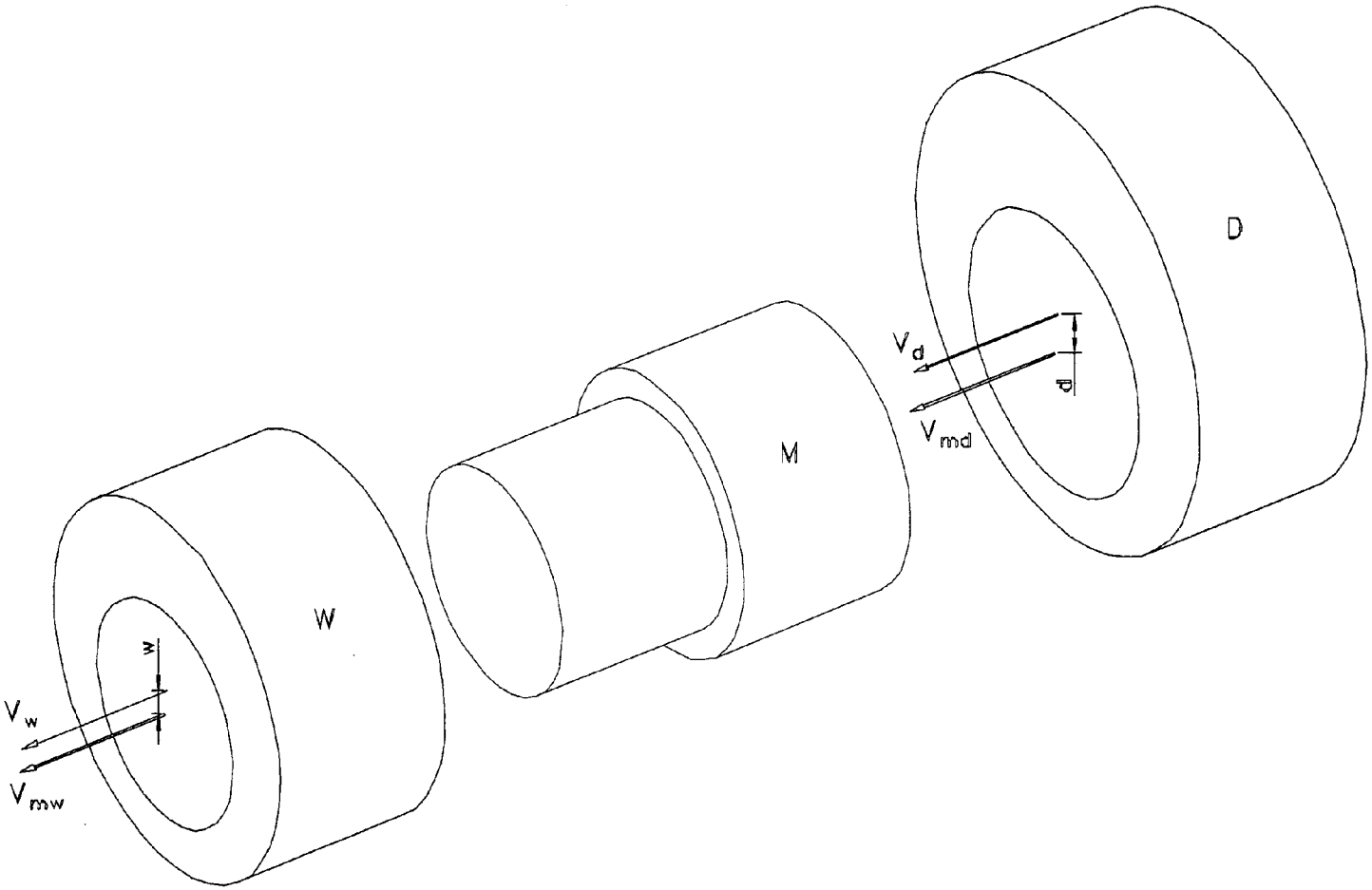
Figure 7:
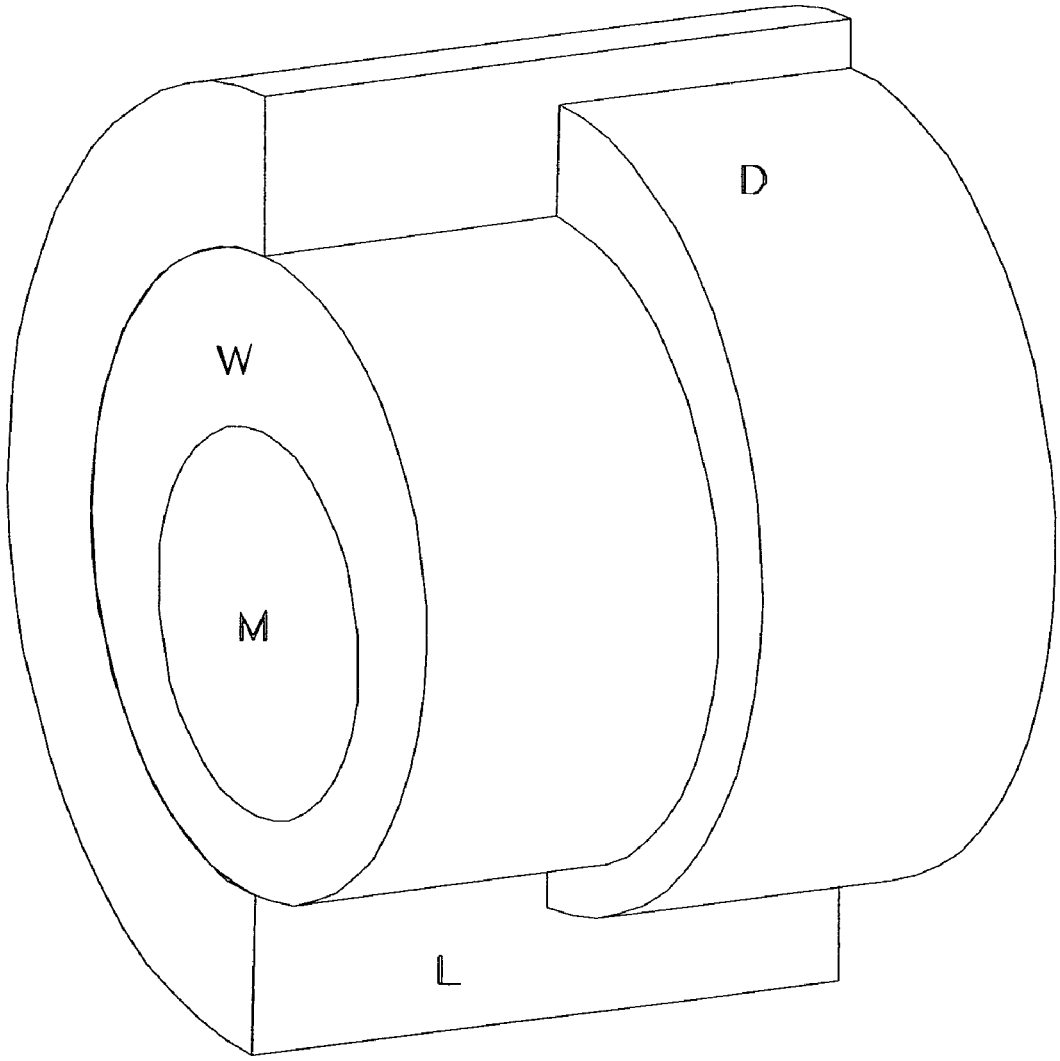
Figure 8:
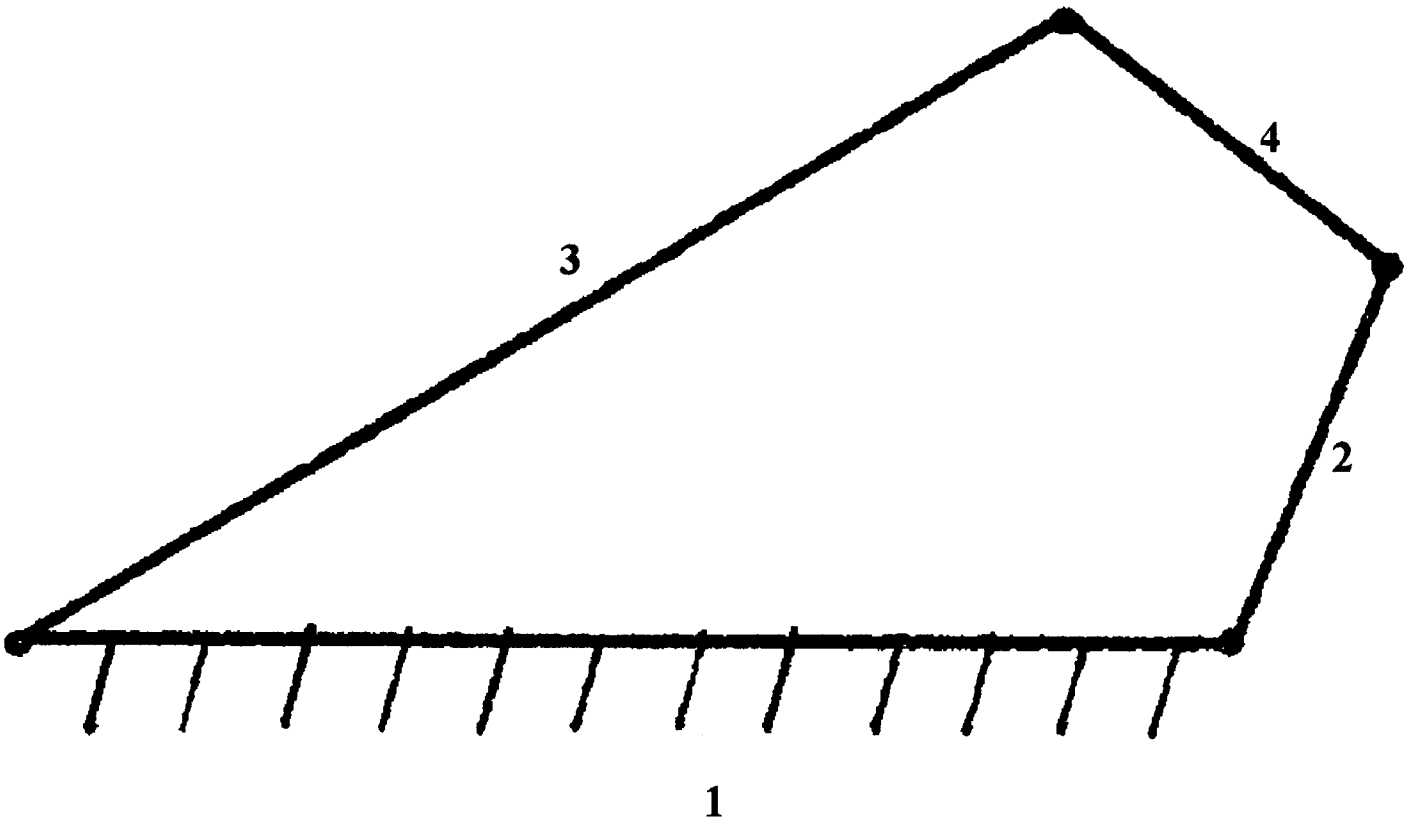
FIGS. 8-12 show a 2-stroke oscillating Diesel cycle "crosshead" engine according to the present invention with double-acting pistons and producing 2 power strokes per shaft revolution. More specifically.

Two Stroke "Crosshead" Oscillating Engine (FIGS. 8-14)

This design provides the canonical form of oscillating engine and is to be considered as basic. This engine is intended for all manner of heavy machinery like excavators, bulldozers, heavy trucks, military vehicles including tanks etc.

This engine uses a flat mechanism of the type described in the section "Summary of the invention". All the kinetic couples of the mechanism are rotary ones. All the following three quantities are equal: Crank radius r of the crankshaft 2, eccentricity ratio e of the intermediate eccentric 4 relative the crankshaft 2, eccentricity ratio E of the intermediate eccentric 4 relative the oscillator 3. The distance d between the axis of oscillation of the oscillator 3 relative the body 1 and the axis of rotation of the crankshaft 2 relative the body 1 is greater than r. The mechanism produces oscillating motion relative the body 1 of the oscillator 3 from rotary movement relative the body 1 of the crankshaft 2, and the oscillation angle of the oscillator 3 relative the body depends on r, d, e and E. Moreover the equality r=e guarantees that the intermediate eccentric 4 executes one full rotation relative the shaft 2 per each full revolution of the shaft 2 relative the body 1 and enables mass forces produced by the engine to be minimized (compare FIG. 8).

Figure 9:
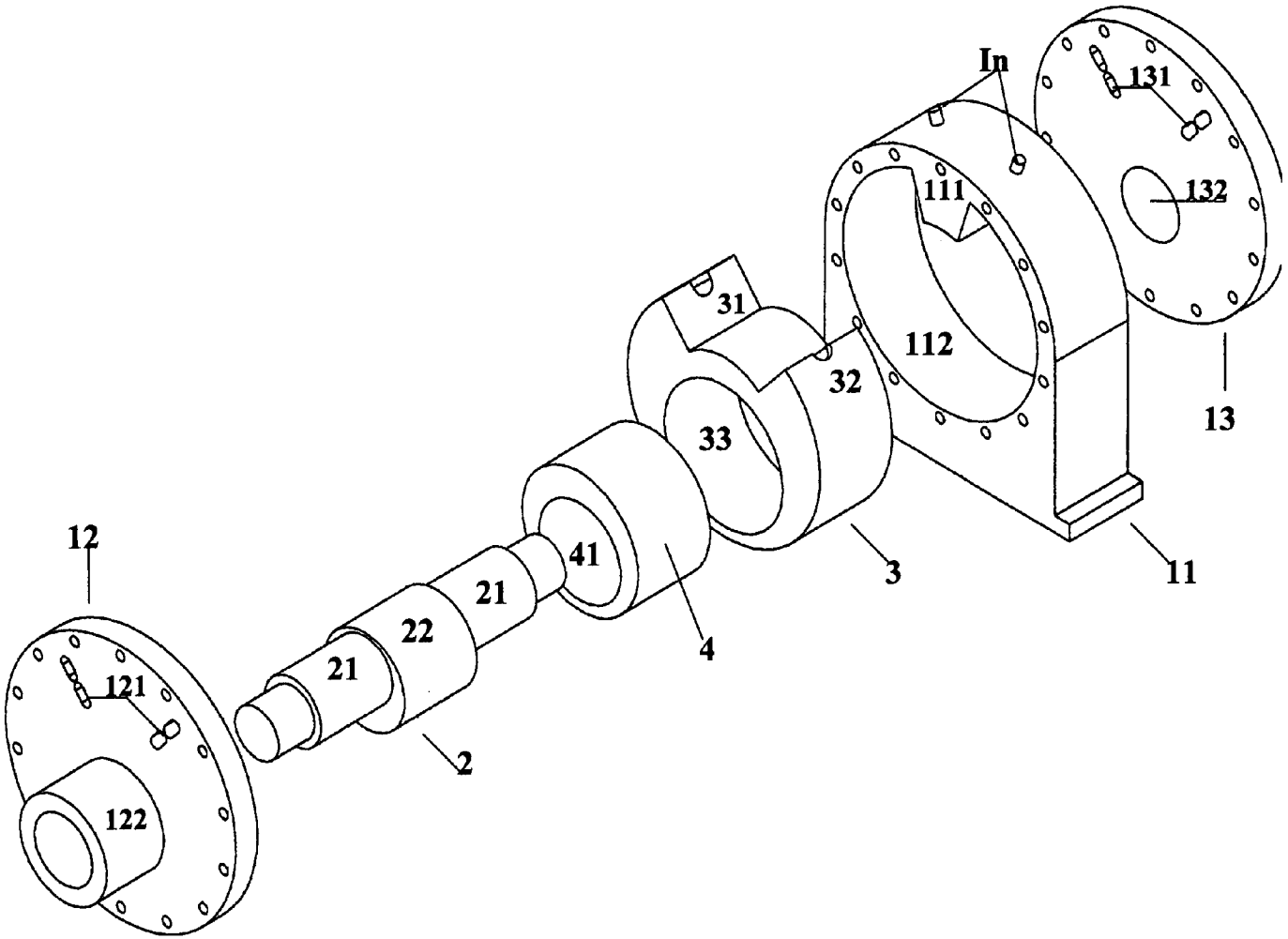
Figure 10:
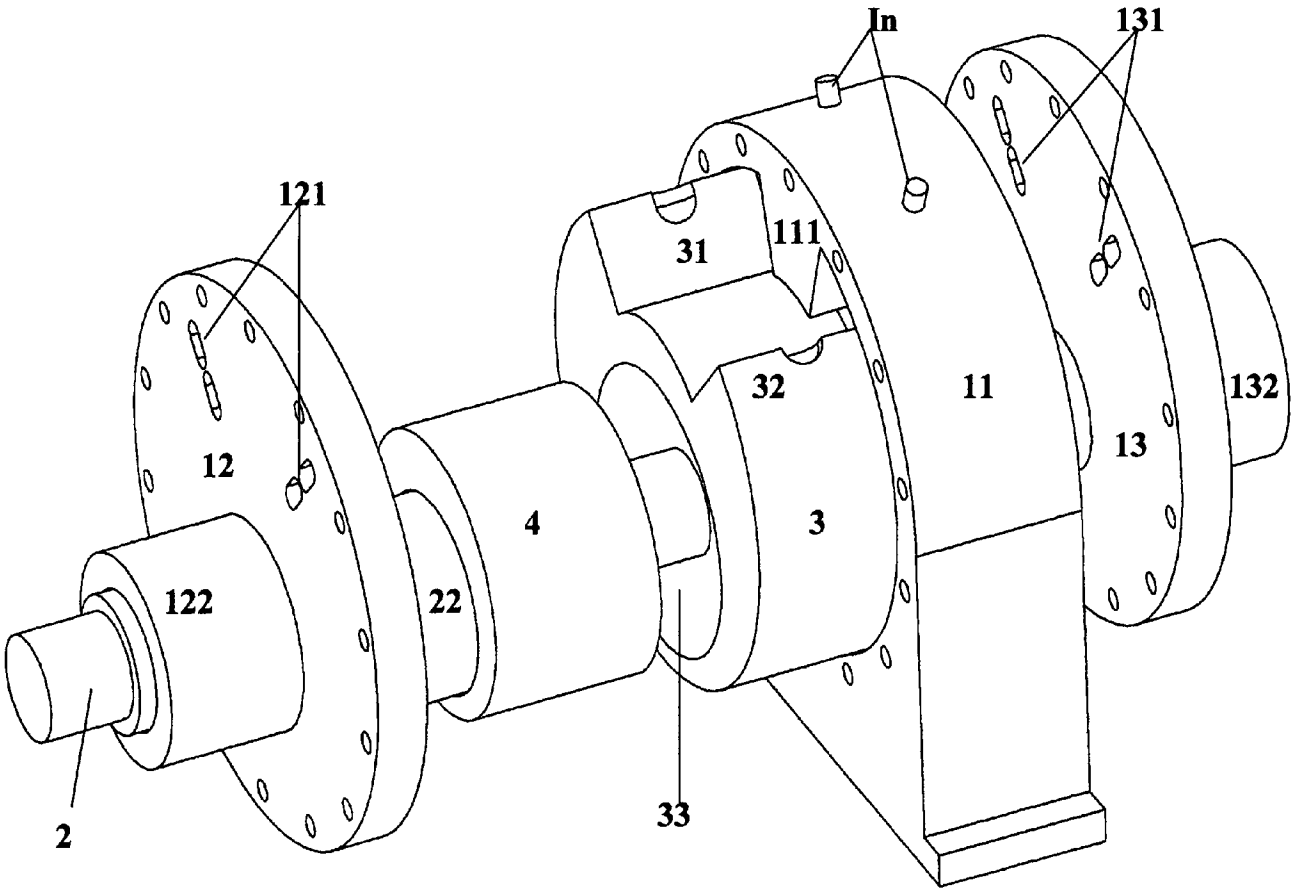

The structure of the engine will be described basing on the FIGS. 9 and 10. The body 1 consists of three components: 11, 12 and 13. Placed on the central piece 11 of the body there is a projection 111. There are also two fuel injectors In positioned in the central portion 11 of the engine body. In the element 12 (respectively 13) of the engine body 1 there are inlet (respectively exhaust) ports 121 (respectively 131). The shaft 2 is equipped with an eccentric 22 and the main pins 21. The main pins 21 are supported in bearings 122 and 132 placed respectively in the parts 12 and 13 of engine's body 1 and the eccentric 22 pivots in the eccentric hollow 41 of the intermediate eccentric 4. The intermediate eccentric 4 pivots on the eccentric 22 of the shaft 2 and in the eccentric hollow 33 in the oscillator 3. The oscillator 3 pivots in the hollow 112 of the central body part 11. Thus the shaft 2 is supported along its full length (the central piece of the shaft is supported in the central body part 11 through the intermediate eccentric 4 and the oscillator 3). The pistons 31 and 32 form the unique whole with the oscillator 3. The projection 11 of the body 1 and internal walls of the elements 12 and 13 form the (two) combustion chambers ("cylinders") C1 and C2 of the engine. Thanks to the placement of the inlet and exhaust ports at the opposite walls of the combustion chambers, the engine incorporates the efficient uniflow scavenging system. There are no valves. The engine oscillator 3 governs opening/shutting of the inlet and outlet ports 121 and 131; thus there are no valves. There is not a camshaft. The injection pump (not shown) is to be driven directly by the shaft 2.

Figure 11:
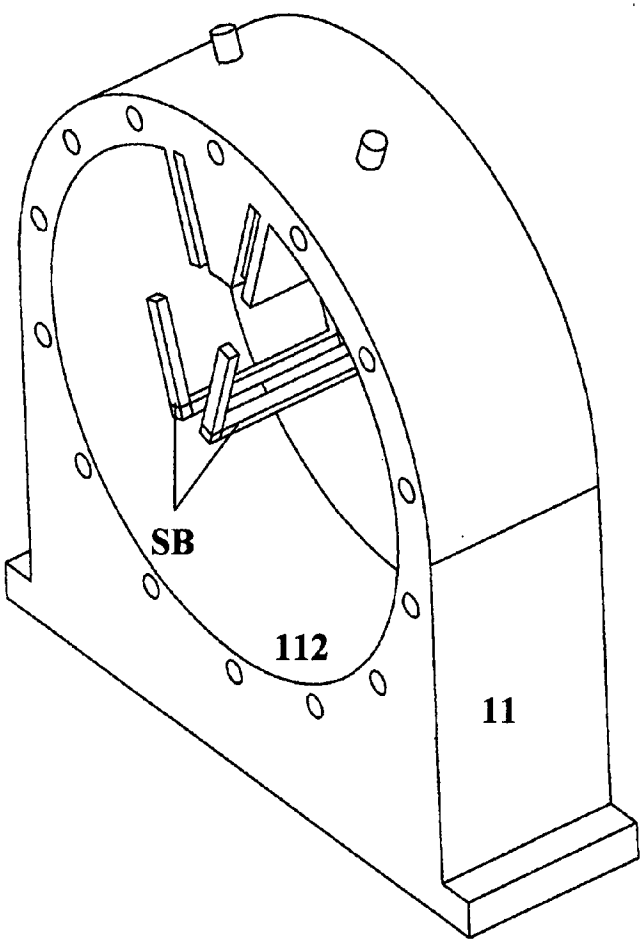
Figure 11:
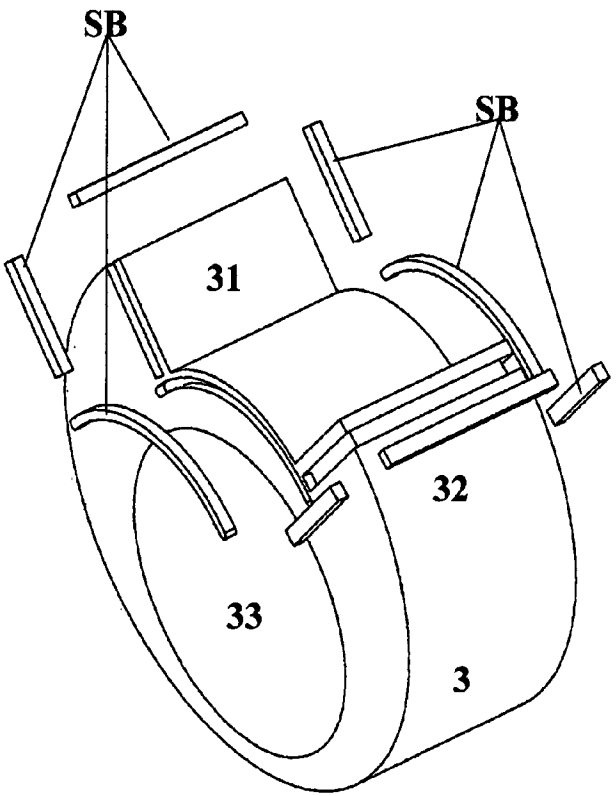
Figure 12:
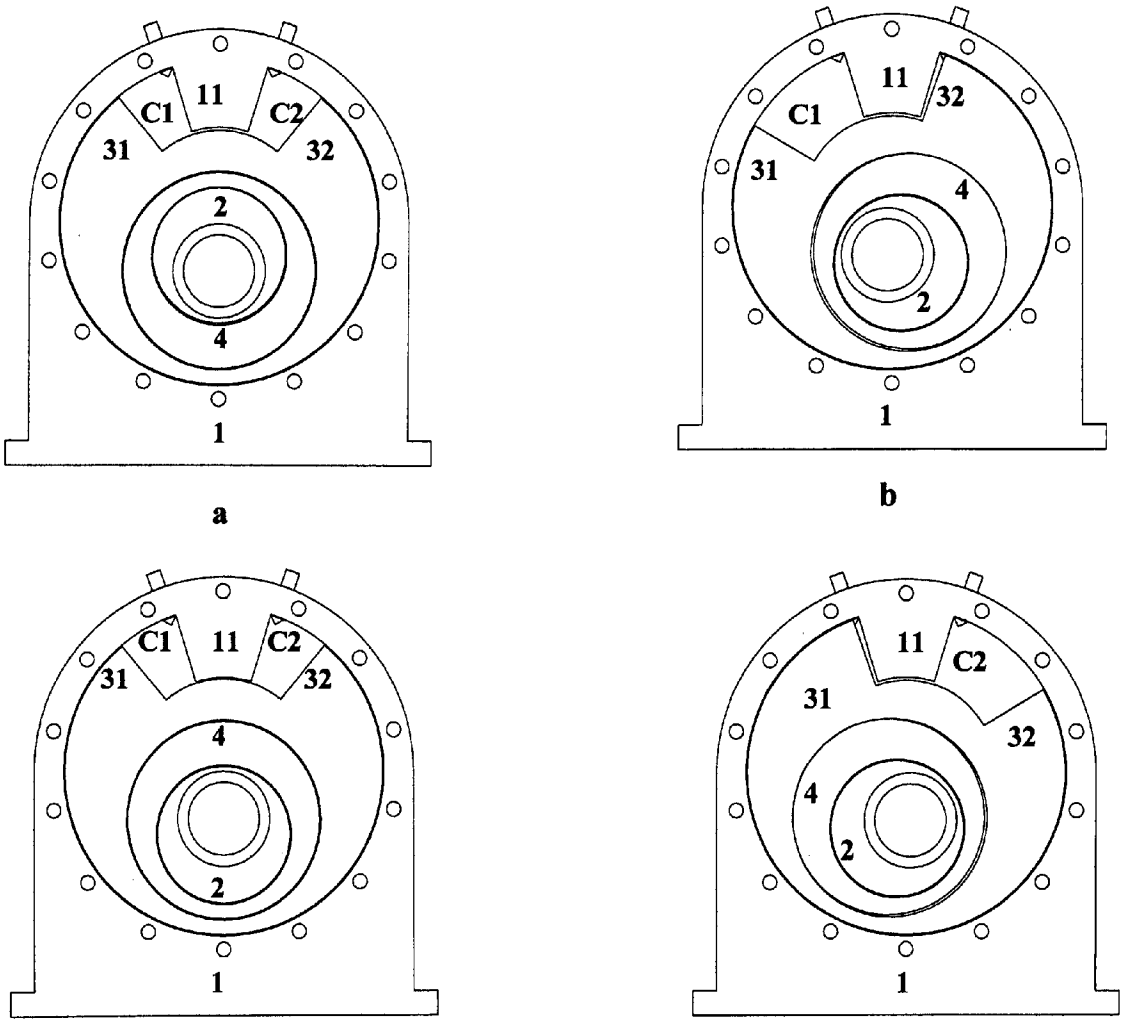

Sealing is indicated in FIG. 11 (it is omitted in other figures to make them more transparent). It uses sealing bars SB like the Wankel engine, however it is to be stressed that the sealing of this engine, unlike that of Wankels, is completely symmetric due to flat/circular shapes of the combustion chambers and therefore almost as simple as that of conventional piston engines.

There is another variant of the engine with differently placed inlet and outlet ports. Namely the inlet and outlet ports are placed on the central part 11 of the body 1, wherein outlet or inlet ports are placed in the projection 111. Opening and closing of the inlet and outlet ports are governed by the oscillator equipped with a suitable gas passage cooperating with the ports placed in the projection 111.

Here is a short description of the engine work (a two-stroke Diesel cycle engine in this instant, compare FIGS. 12*a*-12*d*, which show four subsequent positions of the engine parts; 12*a* shows the "lower" dead centre and FIG. 12*c*—the "upper" dead centre). As the shaft 1 rotates the oscillator 3 oscillates and the "pistons" move in their respective "cylinders" changing the combustion chambers volume, opening and closing inlet and exhaust ports, and thus performing full two-stroke engine cycle in each of its two combustion chambers during each revolution of the shaft. In FIG. 12*b* the "left hand side" combustion chamber C1 assumes its maximum volume, both the exhaust and inlet ports are open and hot low pressure gases are being exhausted while fresh air enters the combustion chamber. The "right hand side" combustion chamber C2 assumes its minimum volume, both the exhaust 131 and inlet 121 ports are closed, and fuel is being injected into the combustion chamber. Next volume of the "left hand side" combustion chamber C1 decreases and fresh air is being compressed; this is the compression stroke. At the same time volume of the "right hand side" combustion chamber C2 increases, and hot high pressure gases contained therein expand producing useful power, this is the power stroke. As volume of the combustion chamber C2 approaches its maximum the oscillator 3 opens the outlet ports 131 and hot low-pressure gases exit the combustion chamber thus causing the pressure to decrease. Next the oscillator 3 opens inlet ports 121 and fresh air driven by a scavenging pump (not shown) enters said combustion chamber and displaces hot gases contained therein. Next the process repeats with the combustion chambers subsequently interchanging their roles (see FIG. 12*d*).

It is clear from my drawings that the structure of this engine is extraordinarily compact and robust, in fact the strongest possible (proof: moving parts of the engine occupy the whole internal space of the body minus half of the swept volume). The structure of all the engine parts is also extraordinarily simple, compact and robust and the whole engine assumes the general shape of tube. In particular, there are no minor parts like piston pin. As it was mentioned above, the engine shaft is being supported along its full length and it is by far stiffer than shafts of conventional engines. Any kinetic couple is the rotary one, and both the members of any kinetic couple contact along a cylindrical surface of a very large area. Thus the engine can incorporate much higher gas pressure and gas force than conventional engines while enjoying specific mechanical loads equal to those to be found in conventional engines. Consequently, the engine can incorporate thermodynamic cycle of extremely high parameters and thermal efficiency without increasing friction and decreasing its mechanical efficiency, thus having extraordinarily high overall efficiency. Initial estimations show that the engine with elements of moderate dimensions in comparison with dimensions of the combustion chamber could cope with maximum gas pressure of 1000-1200 atmospheres (and more) with maximum specific loads not exceeding 300-400 kg/cm$^2$. Another important advantage of this engine over conventional ones is that the gas force is being transferred to the shaft approximately tangentially, and the component of the gas force perpendicular to the wall of the hollow 12 is transferred directly to the engine body by the massive oscillator 3, which therefore plays the role of the crosshead of conventional engines; in particular the engine comprises no hot load bearing sliding components. Thus this two stroke engine structure offers excellent constraints for the piston and sealing bars that are held at normal orientation to the surface of the combustion chamber and do not protrude into the port openings, quite unlike in the case of conventional two-stroke engines. Moreover, by forming in the oscillator 3 two antipodally placed recesses (and thus four "pistons") we can nullify the component of the gas force perpendicular to the wall of the hollow 12 loading the engine body. All these contribute substantially to the engine strength.

It is also worth noticing that this engine construction enables keeping the lubricating oil separate from the fuel and from mixing with the induction air, and allows for the efficient water cooling of the pistons, which is essential for HCCI engines.

This engine has only three moving parts, yet it provides the torque smoothness of a 2 cylinder 2-stroke engine of conventional construction. A larger number of pistons can be attached to the oscillator 3 thus increasing the swept volume and decreasing oscillation amplitude and piston stroke (thus improving balance) at the same time without increasing the number of the engine parts. The engine can be enlarged and its torque smoothness can be improved just by adding more (suitably phased) oscillators.

Detailed discussion of the problem of balancing this engine is beyond the scope of the patent specification. However let us make here several statements on this issue. Thus the problem is analogous to the problem of balancing ordinary piston engine and therefore can be solved by analogous means. In fact this engine is capable of being balanced better than ordinary piston engine. For example, one-oscillator engine can be nearly perfectly balanced by attaching suitable counterweights to the shaft W=2 and the intermediate eccentric M=4 provided that engine's geometric parameters are chosen as described above (recall: Crank radius r of the crankshaft equals the eccentricity ratio e of the intermediate eccentric M=4 relative the crankshaft W=2; both the distance d between the axis of oscillation of the oscillator D=3 relative the body L=1 and the axis of rotation of the crankshaft W=2 relative the body L=1, and eccentricity ratio E of the intermediate eccentric M=4 relative the oscillator D=3 are greater than r; in fact the greater d and E the better balance of the engine can be achieved). Six oscillators engine can be perfectly balanced like the ordinary in line six-cylinder piston engine.

The foregoing description discloses one preferred embodiment of the invention. One skilled in the art will readily recognize from this description and from the accompanying figures and patent claims, that many changes and modifications can be made to the preferred embodiment without departing from the true spirit, scope and nature of the inventive concepts as defined in the following patent claims.

What I claim is:

1. An oscillating internal combustion engine comprising:

a mechanism converting thermal energy of combustion gases to rotational motion;

wherein said mechanism converting thermal energy of combustion gases to rotational motion comprises precisely one stationary link, and precisely three moving links;

wherein said stationary link is an engine body;

wherein said three moving links are:

an oscillator;

an eccentric shaft;

an intermediate eccentric;

wherein said engine body includes a first cylindrical cavity, a second cylindrical cavity, and a third cylindrical cavity placed therein;

wherein the longitudinal axis of symmetry of the first cylindrical cavity included in the engine body coincides with the longitudinal axis of symmetry of the third cylindrical cavity included in the engine body;

wherein the longitudinal axis of symmetry of the second cylindrical cavity included in the engine body is parallel to the longitudinal axis of symmetry of said first cylindrical cavity and said third cylindrical cavity included in the engine body;

wherein the longitudinal axis of symmetry of the second cylindrical cavity included in the engine body is displaced relative the longitudinal axis of symmetry of the first cylindrical cavity and the second cylindrical cavity included in the engine body by a distance l>0;

wherein a number n>0 of projections are placed on the inner circular wall of said second cylindrical cavity included in said engine body;

wherein said oscillator assumes the shape of a first circular solid cylinder with a fourth circular cavity placed therein, and the number n>0 of arcuate cavities placed on the external circumference of said oscillator, defining n>0 pairs of mutually opposed oscillator pistons;

wherein the longitudinal axis of symmetry of said oscillator is parallel to the longitudinal axis of symmetry of said fourth circular cavity placed therein;

wherein the longitudinal axis of symmetry of said oscillator is displaced relative the longitudinal axis of symmetry of said fourth circular cavity placed in said oscillator by a distance d>0;

wherein said oscillator is mounted rotatably in the second cylindrical cavity included in the engine body to form with the engine body a first rotary or oscillating kinetic couple of said mechanism converting thermal energy of combustion gases to rotational motion;

wherein each projection of said n projections placed on the inner circular wall of the second cylindrical cavity of said engine body is placed in one arcuate cavity of said n arcuate cavities placed on the external circumference of said oscillator, so that said n projections placed on the inner circular wail of the second cylindrical cavity of said engine body form with said n arcuate cavities placed on the external circumference of said oscillator 2*n* gas-tight working chambers;

wherein the axis of rotation of the oscillator relative the engine body coincides with the longitudinal axis of symmetry of the second cylindrical cavity included in the engine body;

wherein the longitudinal axis of symmetry of said fourth circular cavity included in said oscillator is parallel to the axis of rotation of the oscillator relative the engine body;

wherein said eccentric shaft has a first pin, a second pin, and an eccentric placed between said first pin and said second pin;

wherein the longitudinal axis of symmetry of said first pin of said eccentric shaft coincides with the longitudinal axis of symmetry of said second pin of said eccentric shaft; wherein the longitudinal axis of symmetry of said eccentric of said eccentric shaft is parallel to the longitudinal axis of symmetry of said first pin of said eccentric shaft and the longitudinal axis of symmetry of said second pin of said eccentric shaft;

wherein the longitudinal axis of symmetry of said eccentric of said eccentric shaft is displaced relative the longitudinal axis of symmetry of said first pin of said eccentric shaft and the longitudinal axis of symmetry of said second pin of said eccentric shaft by a distance w>0;

wherein said eccentric shaft is mounted rotatably in the engine body to form with the engine body a second rotary kinetic couple of said mechanism converting thermal energy of combustion gases to rotational motion;

wherein said first pin of said eccentric shaft pivots in said first circular cavity included in said engine body, and said second pin of said eccentric shaft pivots in said third circular cavity included in said engine body;

wherein the axis of rotation of the eccentric shaft relative the engine body coincides with the longitudinal axis of symmetry of said first cylindrical cavity included in said engine body and the longitudinal axis of symmetry of said third cylindrical cavity included in said engine body, so that said axis of rotation of the eccentric shaft relative the engine body is parallel to said axis of rotation of said oscillator relative said engine body;

wherein said intermediate eccentric assumes the shape of a second circular solid cylinder with a fifth circular cavity placed therein;

wherein the longitudinal axis of symmetry of said intermediate eccentric is parallel to the longitudinal axis of symmetry of said fifth circular cavity placed therein;

wherein the longitudinal axis of symmetry of said intermediate eccentric is displaced relative the longitudinal axis of symmetry of said fifth circular cavity placed in said intermediate eccentric by a distance m>0;

wherein said intermediate eccentric is mounted rotatably in said fourth circular cavity included in said oscillator so that the intermediate eccentric forms with the oscillator a third rotary kinetic couple of said mechanism converting thermal energy of combustion gases to rotational motion;

wherein the axis of rotation of said intermediate eccentric relative the oscillator coincides with the longitudinal axis of symmetry of said fourth circular cavity included in said oscillator so that said axis of rotation of said intermediate eccentric relative the oscillator is parallel to said axis of rotation of said oscillator relative said engine body and said axis of rotation of said eccentric shaft relative said engine body;

wherein said eccentric of said eccentric shaft is mounted rotatably in said fifth circular cavity included in said intermediate eccentric so that the intermediate eccentric forms with the eccentric shaft a fourth rotary kinetic couple of said mechanism converting thermal energy of combustion gases to rotational motion;

wherein the axis of rotation of said intermediate eccentric relative the eccentric shaft coincides with the longitudinal axis of symmetry of the eccentric of said eccentric shaft, so that said axis of rotation of said intermediate eccentric relative the eccentric shaft is parallel to the axis of rotation of said intermediate eccentric relative the oscillator, said axis of rotation of said oscillator relative said engine body, and said axis of rotation of said eccentric shaft relative said engine body;

wherein the distance w>0 between the longitudinal axis of symmetry of said eccentric of said eccentric shaft and the longitudinal axis of symmetry of said first pin of said eccentric shaft and the longitudinal axis of symmetry of said second pin of said eccentric shaft is smaller than the distance d>0 between the longitudinal axis of symmetry of said oscillator and the longitudinal axis of symmetry of said fourth circular cavity placed in said oscillator;

wherein said engine body includes at least n outlet ports, at least n inlet ports, and at least n fuel injectors.

2. The oscillating internal combustion engine according to claim 1, wherein d+1>w+m.

3. The oscillating internal combustion engine according to claim 2, wherein w=m.

4. The oscillating internal combustion engine according to claim 1, wherein d=1.

5. The oscillating internal combustion engine according to claim 1, wherein said engine body includes a central cylindrical element, and a first side element assuming the form of circular plate, and a second side element assuming the form of circular plate.

6. The oscillating internal combustion engine according to claim 5, wherein said inlet ports and outlet ports are placed on said central cylindrical part of the engine body.

7. The oscillating internal combustion engine according to claim 5, wherein said inlet ports are placed on said first side circular element of the engine body, and said outlet ports are placed on said second side circular element of the engine body.

8. The oscillating internal combustion engine according to claim 5, wherein said outlet ports are placed on said central cylindrical part of the engine body, and said inlet ports are placed on said first side circular element of the engine body, and/or on said second side circular element of the engine body.

* * * * *